US007011426B2

(12) United States Patent
Gabor

(10) Patent No.: US 7,011,426 B2
(45) Date of Patent: Mar. 14, 2006

(54) MODULAR ELECTRONIC CANDLE

(76) Inventor: Lederer Gabor, 8 Amethyst La., Paterson, NJ (US) 07501

( * ) Notice: Subject to any disclaimer, the term of this patent is extended or adjusted under 35 U.S.C. 154(b) by 0 days.

(21) Appl. No.: 10/666,731

(22) Filed: Sep. 19, 2003

(65) Prior Publication Data

US 2004/0179355 A1 Sep. 16, 2004

Related U.S. Application Data

(60) Provisional application No. 60/453,611, filed on Mar. 11, 2003.

(51) Int. Cl.
*F21L 19/00* (2006.01)
*F21V 19/00* (2006.01)

(52) U.S. Cl. ..... 362/161; 362/203; 362/392; 362/810

(58) Field of Classification Search ..... 362/161, 362/203, 392, 810, 157
See application file for complete search history.

(56) References Cited

U.S. PATENT DOCUMENTS 1,479,860 A * 1/1924 Lewis ..... 362/190
4,864,474 A * 9/1989 Maglica ..... 362/203
5,863,108 A * 1/1999 Lederer ..... 362/186
6,066,924 A * 5/2000 Lederer ..... 315/185 R
2005/0002188 A1 * 1/2005 Bucher et al. ..... 362/227

* cited by examiner

*Primary Examiner*—Thomas M. Sember
*Assistant Examiner*—James W Cranson, Jr.
(74) *Attorney, Agent, or Firm*—Israel Nissenbaum

(57) ABSTRACT

A self standing or base supportable modular cylindrical electric candle with multiple battery compartments of parallel pairs and dual end plate terminal contacts, which are compressed with a screwed compression to complete a lighting circuit with a bulb, LED or other lighting source. The plates are adapted to prevent incorrect battery placement. A candle emulating lighting source is contained within a transparent cylinder of the candle with the contact plates electrically connected to terminals of a flicker circuit emulating board. The board is adaptable to LEDs of different colors (e.g., red, green, blue or yellow). One end of the cylinder is closed with a cavity member having peripheral space for placement of visible indicia. A compression screwing handle is provided with a turn locking member to prevent unauthorized battery removal. The base is configured to be engaged by a supporting member or ground anchor.

11 Claims, 9 Drawing Sheets

MODULAR ELECTRONIC CANDLE

FIELD OF THE INVENTION

This invention relates to battery-containing electronic candles which are self contained and self-supporting and capable of remaining lit for up to a half a year at a time.

BACKGROUND OF THE INVENTION

Flame candles are often utilized for symbolic religious reasons such as votive candles used in church vestibules and menorahs used on Hannukah. Flame candles are also used for decorative purposes such as in restaurants and for the subdued ambient lighting they provide. Another common use is as a memorial symbol such as at a gravesite. Electronic candles have been accordingly been developed In order to provide a steadier and more reliable light (often at a lower cost) and to minimize dangers associated with open flames, especially when used in large numbers (e.g. extensive votive candle displays) and in public settings. These electronic candles have no open flames and they include special bulbs or LEDs and/or circuitry to enable them to very closely simulate the appearance of a flame candle and the random flicker thereof. In addition, even the largest flame candles have a finite life-time, rarely exceeding a week and longer periods are often desired and only possible with electrically powered lights.

Electronic candles also have secular utility such as decorative lighting in gardens and it is desirable that they be capable of extended lighting duration with minimized battery replacement requirements For extensive and reliable operation, electronic candles have generally been powered by AC current, either directly or with an AC/DC transformer-rectifier, depending on the utilized bulb parameters. Such candles, connected to a constant current supply, are accordingly capable of being left unattended and remaining indefinitely lit for extended periods of time. Attached timer circuitry provides timer control for selective lighting times.

Alternatively, and less commonly, such candles are powered by direct DC battery current with the batteries contained in a separate supporting base. Such candles are however not generally utilizable as integrally complete units without such base. Additionally, battery powered candles are limited by the available battery capacity and have usable lifetimes often comparable only to that of flame candles. Some completely contained electronic candles have been developed for areas not accessible by electric current lines such as cemeteries but they have been simply lighting fixtures and not true candle emulations.

SUMMARY OF THE INVENTION

It is accordingly an object of the present invention to provide a self standing electronic candle or candle attachable to a ground anchor which candle is capable of being lit for extended periods of time with realistic candle emulation.

It is a further object of the present invention to provide a self contained electronic candle with rugged and easily deployable contact pressure switching elements and locking elements to prevent unauthorized battery removal.

It is yet another object of the present invention to provide said candle with integrated elements for connection to a support member, and with a cavity for accommodation and display of objects for decorative or memento purposes and areas for indicia placement.

It is still yet another object of the present invention to provide said electronic candle with changeable decorative panels for appearance changes.

It is another object of the present invention to provide such candles with selectable light sources, preferably with easy to change means, or light sources with their electronic driver circuitries such as incandescent bulbs, LEDs and the like with the latter providing low drain light sources and being selectively capable of providing different decorative colors.

Generally the present invention comprises a self supporting electronic candle ("self supporting" as used herein also includes candles adapted to be attached to ground anchors) comprising a chambered housing body, serving as a battery compartment, configured for containing at least two batteries (electrochemical cells having separate casings are referred to as batteries herein).

The battery compartment is provided with conductive end plates and means for causing batteries, contained in the battery compartment, to contact the end plates to complete a circuit. A light source, contained within the electronic candle, and having candle flicker emulation is electrically powered by such completed circuit to provide light from the electric candle. Translucent decorative enclosure means are integrated with the candle housing body to enclose the light source there within. Since the electronic candle is primarily for use out of doors it is provided with means for locking the device in place and preventing unauthorized removal of batteries therefrom. The candle is provided with indicia displaying means for use in a symbolic setting and with means for leaving a memorial such as a stone or flower thereon when used as a grave memorial marker.

The above and other objects, features and advantages of the present invention will become more evident from the following discussion and drawings in which:

SHORT DESCRIPTION OF THE DRAWINGS

DETAILED DESCRIPTION OF THE INVENTION

Figure 1:
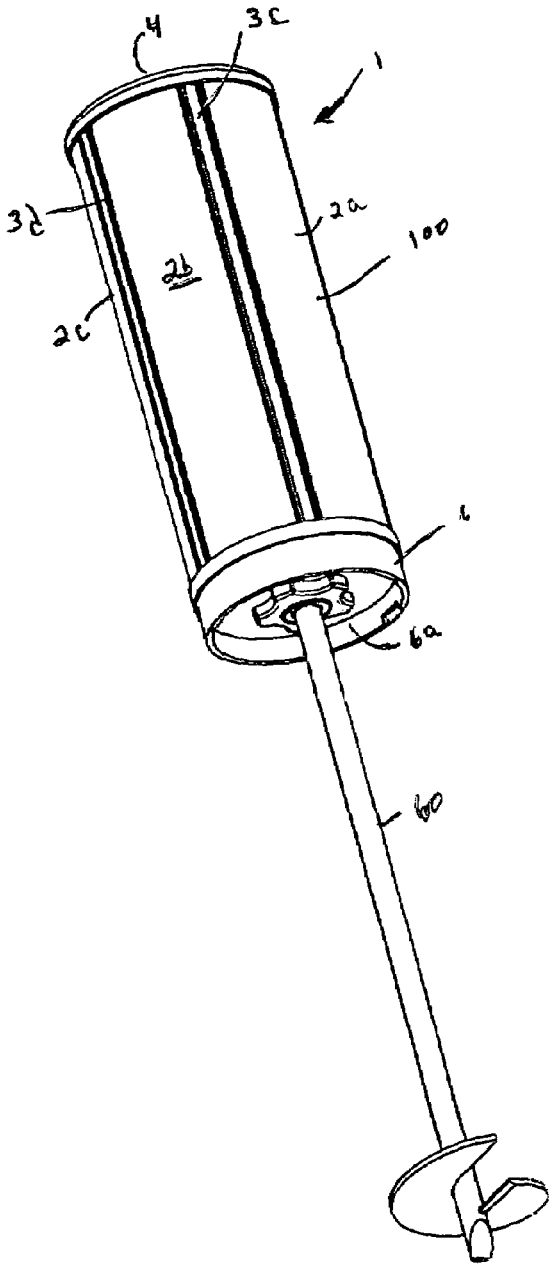
FIG. 1 is an exterior perspective bottom view of the candle of the present invention showing the light actuation means and base or support connection with locking means removed for clarity.

The housing of the electronic candle of the present invention is preferably cylindrical, to more closely emulate the flame counterpart. The cylindrical candle body shape housing is provided with open ends for insertion of batteries into the battery compartment and for respective exposure of the battery terminals to conductive plate elements. The housing body further comprises means for supporting a light source electrically connected to said batteries and wherein said light source is electrically activated by circuit activation means.

Preferably, the candle body shape housing further comprises means for placement of outer translucent decorative panels thereon to form a decorative candle enclosure through which light from the lighting source is visible as a candle flicker. The decorative panels extend from the housing body to form a translucent enclosure for the light source and through which light from the light source is visible. The panels are of selected colors which are preferably matched to the lighting source.

End caps close the interior of the candle from the exterior environment. The upper cap has a rim for indicia placement as well as an integral cup shaped portion to receive small memorial objects such as stones, notes, flowers and the like.

The light source is preferably integrated with a circuit board adapted to the specific light to provide a candle emulation flicker and to provide a specific color. Examples of specific LEDs suitable for use in the candles of the present invention include those available from Marktech Optoelectronics and specifically those designated COTCO LC503THR1-30Q (red); LC503PPG1-30Q (green); LC503PBL1-30Q (blue); LC503TYL1-30Q (yellow) with performance specifications being available therewith for modification to the requisite circuitry.

The open ends of the battery compartment, within the enclosure, are closed with separate conductive plates, which provide circuit activation and mechanical circuit support means. The lower plate is in gravitational or spring contact with one terminal of the batteries (either one battery or batteries in parallel and/or series. The other of the plates (top plate) is normally slightly spaced from the other terminal of the batteries. Preferably, one of the plates is in a fixed position (the upper (or inner plate)) and the other plate (the lower or outer plate) is movable for activation of the lighting source and the candle. Compression means compress the plates whereby the batteries electrically contact both plates for circuit completion and activation of the lighting. Batteries used herein have respective end terminals to permit such circuit completion compression with electrical activation. A preferred compression mechanism comprises an externally threaded electrically conductive rod which passes through an aperture in the lower plate and which threadingly engages a handle turning member which is abutted against the outer surface of the lower or movable plate. Turning of the handle causes it to ride on the threads of the rod with concomitant compression movement of the unattached freely moving bottom plate to effect electrical contact between and separation of the batteries with the upper plate and circuit completion as an on/off switch. The circuit board is part of the electric circuit and is electrically connected to the LED lighting source and to the upper conductive plate and conductive rod. The circuit board preferably is fixedly but removably positioned within a slot in the upper plate (with the lighting source such as the LEDs being located above the upper plate) and is connected to both leads of the LED. One lead of the LEDs is electrically connected to the upper plate via the circuit board and the other lead is electrically connected to the lower plate via connection of the board to the conductive rod such as with a compressed conductive spring.

Flashlights and electric votive candles have embodied contact plates for positive and negative battery terminals, for example, U.S. Pat. No. 5,980,064, but they have generally not embodied switching elements with such plates nor have they utilized the effecting of electrical contact with plate movement.

Threading of the handle on the rod causes the plate to move together with the batteries into electrical engagement with the other plate to complete an electrical circuit (respective plates being in electrical contact with respective terminals of the lighting source). Deactivation of the circuit is effected by unthreading which causes the batteries to be removed from contact with the upper plate. The rod itself is preferably conductive and forms part of the conductive circuit. It is preferred that at least one of the plates be provided with conductive spring loaded contact members positioned at the terminal contact of the batteries with at least one plate member, to ensure that all of the batteries are in full electrical contact with said compression. Where the rod forms part of the circuit, a constant spring loaded connection between the rod and the plate is also provided.

Furthermore the upper body contact plate is mounted to the candle cover plate which provides protrusions through the contact plate to prevent reverse polarity of the batteries. If the flat negative battery terminal contact is placed against the protrusion the plate will not touch the battery contact. The positive terminal however has a protruding nipple which bridges the gap created by the plastic protrusions to ensure proper polarity placement.

In a preferred embodiment, the lower plate is removable from the candle to expose the interior battery compartment whereby batteries may be inserted. In order to prevent unauthorized battery removal, the handle is wedged against a turn prevention member a portion of which fits within a cutout of the candle container with the turn prevention member being affixed to the candle end cap thereby preventing rotation of the handle and removal of the plate when the turn prevention member is locked in position. A portion of the handle thread, which does not externally engage the rod, may be threadingly engaged with a cofitting support member. Preferably however, the rod is also internally threaded for such engagement The container itself is preferably comprised of an integrally molded body member having close fitting compartments for snugly holding batteries therein. The body member is configured with a central aperture (through which the rod at least partially extends) with the compartments being positioned therearound. The body member ends are configured for fixed attachment of an open bottom cap (to accommodate the bottom plate) and a closeable top cap (to cover the top plate, circuit board and light source (e.g., LEDs) with a removable cover for the latter to permit ready removal and exchange of LEDs and circuit boards). The outer periphery of the body member is provided with slots for insertion of elongated channel members, which, in turn, are slotted to retain external removable curved translucent colored decorative panels. The channel members are anchored to the bottom cap and are left open at the top (with an extension beyond the body member and lighting source) for emplacement of a removable cup (to accommodate religious or other small mementos), with closure and indicia (name, organization, ceremonial purpose, etc.). For decorative purposes, the translucent curved panels of different colors and design may be interchanged, as desired. Additionally, LEDs or different colors may be substituted for each other with appropriate circuit boards and voltage drains.

A common use for the candles of the present invention is as a religious or memorial marker such as at gravesites. Accordingly, in a preferred embodiment, the upper end of the candle is configured with an end closure comprising a cup or cavity for containment of memorial markers or mementos such as pebbles (commonly placed on graves as a sign of respect). In addition, the cup is configured with a rim of sufficient dimension to permit placement of indicia such as names of people or sponsors thereon. This indicia, with peripheral placement, does not obscure any of the markers or mementos placed in the cup. An outer removable cover protects both the contents of the cup and the peripheral indicia.

The lighting source such as bulbs, LEDs and the like is positioned within the candle container, preferably in abutment with the upper plate. In order to provide a candle flicker emulation, several bulbs or LEDs and the like are placed in series with a flicker circuit board having two external terminals for electrical engagement with the upper and lower plate members respectively. A description of the flicker emulation is contained in U.S. Pat. No. 6,066,924 issued May 23, 2000, to the present applicant, the disclosure of which is incorporated herein by reference thereto. The circuit board, of an insulative material, may be placed in notches formed in the upper plate, thereby providing positive support for the attached lighting source elements. A removable light diffusion cover is preferably placed over the lighting source to provide a softer light. Flashlight type bulbs provide a brighter light but with the increased power usage, battery life is shortened. LEDs provide a generally less intense light but with an increased battery life.

The battery compartment is preferably shaped to the dimensions of the batteries to be used, e.g., D size batteries, with the formation of battery wells. Stacking of the batteries within a well provides a serial connection and additive voltages (e.g., two alkaline batteries provides an initial nominal voltage of about 3 volts. Additional wells and stacking of batteries provides parallel connections between the plates and increased capacity. Depending on the length of lighting time desired not all of the wells need be filled. With five wells (i.e., ten D cells) total battery capacity is sufficient to continuously power low drain LEDs for a half a year before battery replacement becomes necessary. To ensure proper polarity (especially for driving LEDs) it is preferred that battery orientation means be included in the candle. In a preferred embodiment, one plate, preferably the upper plate, is provided with inwardly extending off center plastic teats above each battery compartment. Cylindrical batteries have one flat terminal end (–) and one terminal end (+) with a nipple and the plastic teats provide a stand-off to prevent contact of the flat terminal with the plate. However, the battery nipple is higher than the plastic teat and contact with the plate thereby is not impeded.

DETAILED DESCRIPTION OF THE DRAWINGS AND THE PREFERRED EMBODIMENT

Figure 1A:
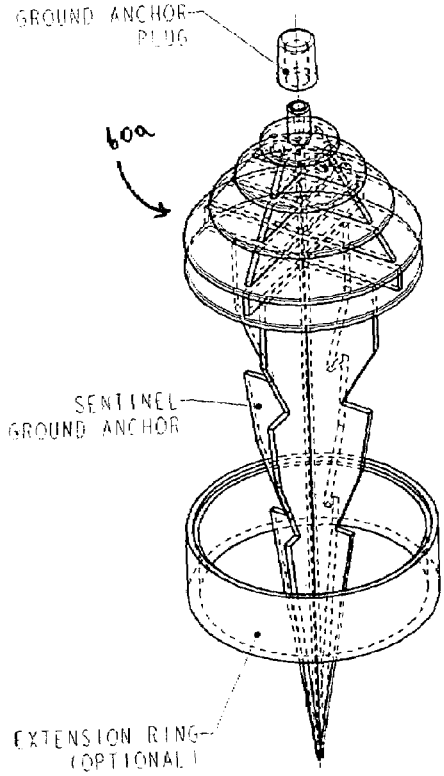
FIG. 1A is a second embodiment of an anchoring element for the candle of FIG. 1.

With reference to the drawings, in FIG. 1, electronic candle 1 is shown affixed to anchor 60, which is in turn anchored into the ground, such as the grounds of a cemetery. FIG. 1A depicts an alternative spike stake 60*a* for use as an anchor element.

Figure 2:
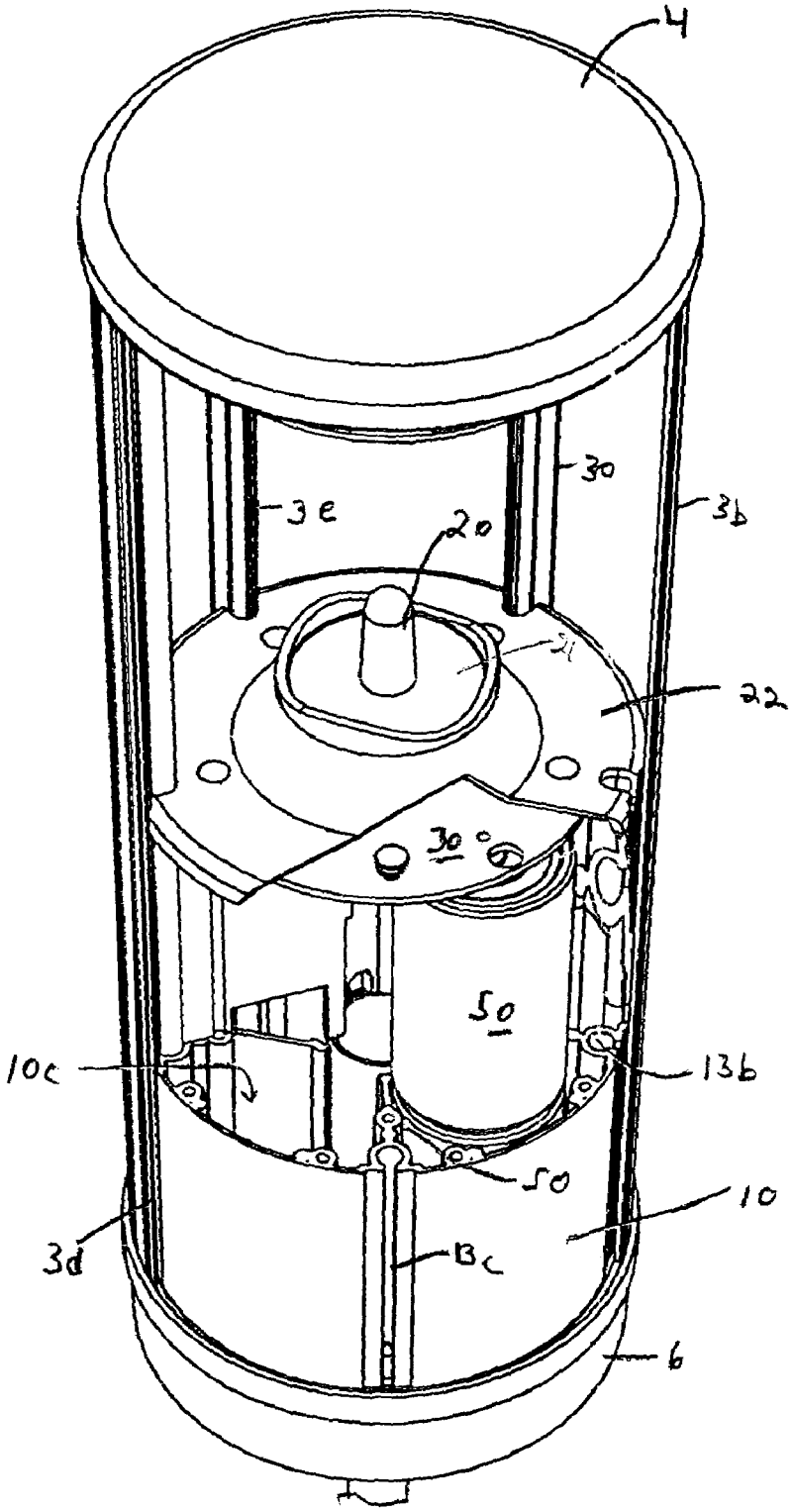
FIG. 2 is a side perspective sectioned view of a candle of the present invention showing the battery compartment with two batteries and light source placement.
Figure 7:
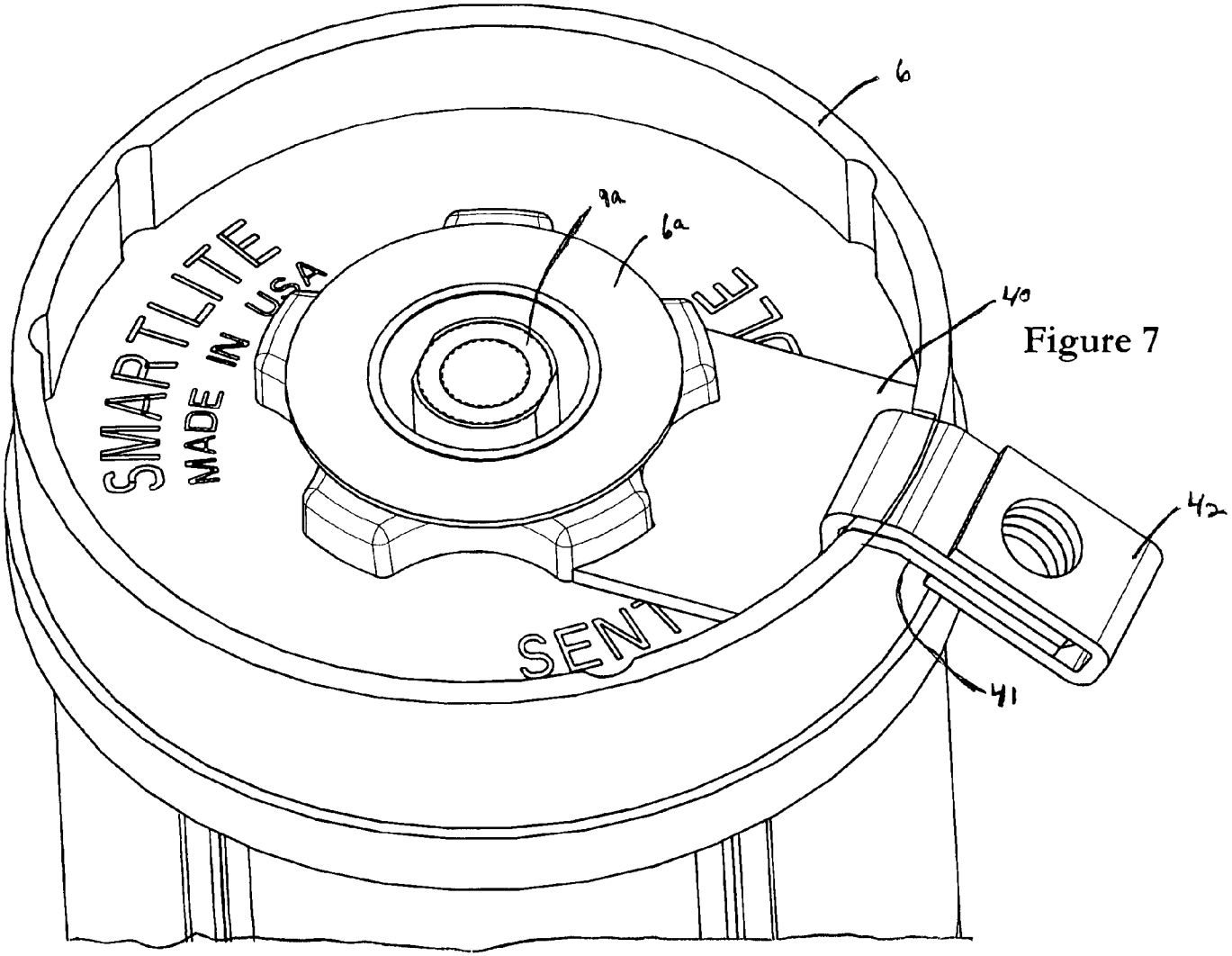
FIG. 7 is a lower perspective view of the candle of FIGS. 1 and 2 with locking elements.

The upper end of anchors 60 and 60*a* is threaded for threading engagement with the internal thread of threaded rod 9*a* (more clearly seen in FIG. 7). The candle 1 is comprised of a translucent cylinder shaped body 100 of curved panels 2*a–e* (panels 2*a–c* are visible). The ends of the cylinder are closed by end caps 4 and 6. Elongated supporting channels 3*a–e* (3*c* and 3*d* are visible in FIG. 1) hold the curved panels 2*a–e* in place and extend between end caps 4 and 6, providing structural rigidity to the candle 1. In FIG. 2, portions of panels 2*a* and 2*b* are shown removed whereby the interior of the candle is visible. Light source 20 (more clearly seen in FIG. 5) is centrally positioned and contains two LEDs 20*a* and 20*b* (with LEDs of desired colors being interchangeable with appropriate change of the circuit board 23). Circuit board 23 is printed or is otherwise provided with candle flicker emulation circuitry and the requisite drivers and circuitry for the selected LEDs (the parameters for the circuitry are available from the LED suppliers). Light diffusing cap 21 is positioned over the LEDs and seated onto insulative cover 22. Light from light source 20 diffuses through the translucent panels 2*a–e* to provide a very realistic flame candle emulation.

As shown in FIGS. 2, 4, 5, 6 and 8, the solid core of the electronic candle 1 is cylindrical body member 10. The cylindrical body member 10 has five separate battery compartments 10*a–e* (compartments 10*b* and 10*c* are visible in FIG. 2), radially positioned around central core cylinder 10'. As shown, each compartment contains two batteries 50 in series. Though in the embodiment, as shown, each compartment must contain two batteries, any number of compartments may be filled or left empty (a minimum of one compartment must of course contain batteries for operability) since the compartments are arranged for parallel battery placement. With activation, all of the upper batteries of positive polarity (as shown) electrically contact upper conductive plate 30 and all of the lower batteries of negative polarity (as shown) electrically contact lower plate 7 with spring contacts 7*a–e* (as more clearly shown in FIGS. 8 and 9). To ensure maintenance of proper polarity, upper plate 30 is provided with standoff members 25 which extend into each of the respective battery chambers. The standoff members 25 are of a height less than that of the respective battery nipples 50*a*, and are positioned off center of the respective chambers. As a result contact with plate 30 is possible with correct placement of the positive terminal with extending nipple. Incorrect placement of the battery 50 with flat negative terminal against the stand-off 25 results in no electrical contact occurring or light activation.

Figure 3:
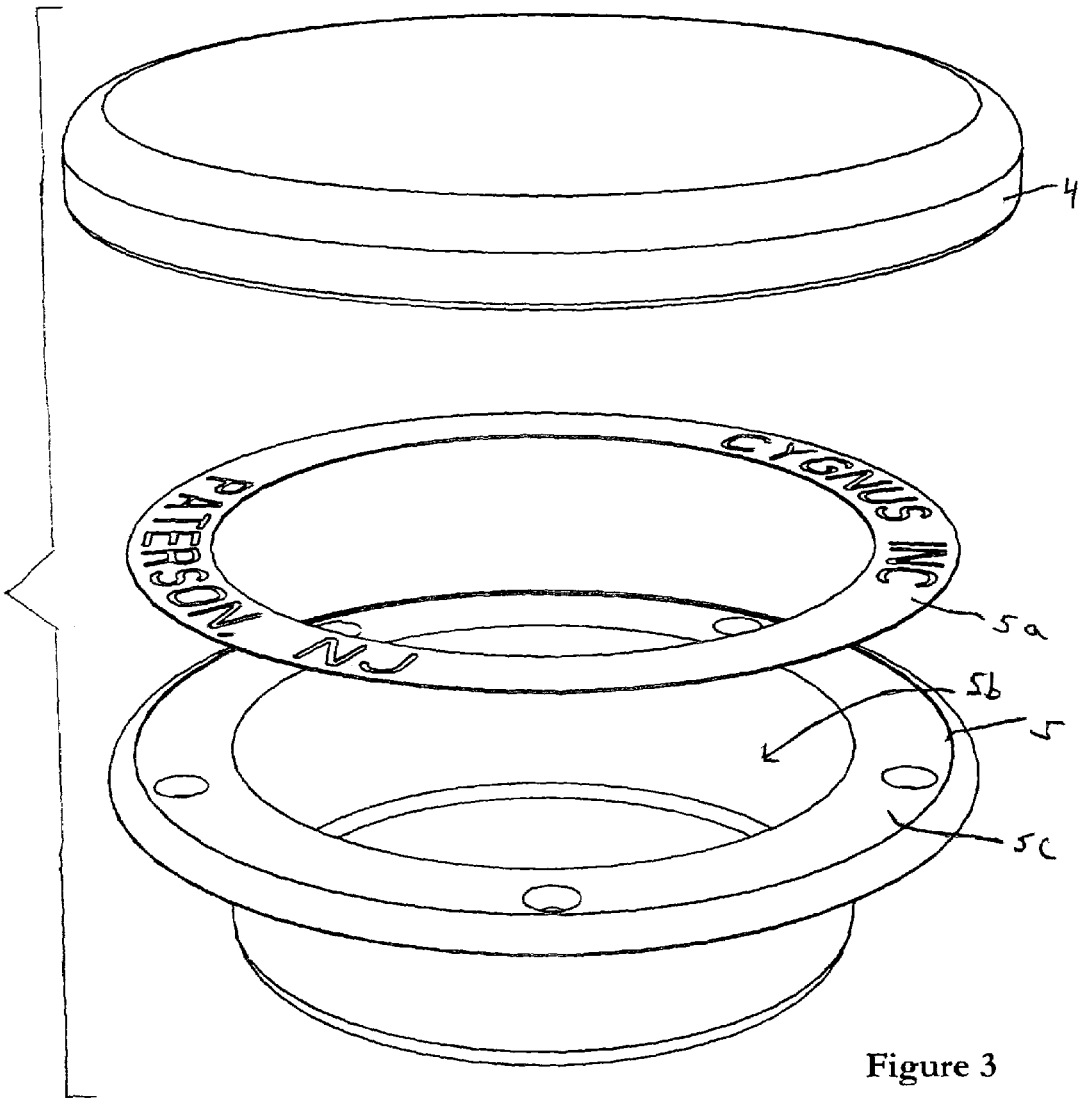
FIG. 3 is a blow-up view of the upper end cap of the candle of FIGS. 1 and 2 showing an object or memento-containing cavity and non-obscuring indicia.
Figure 4:
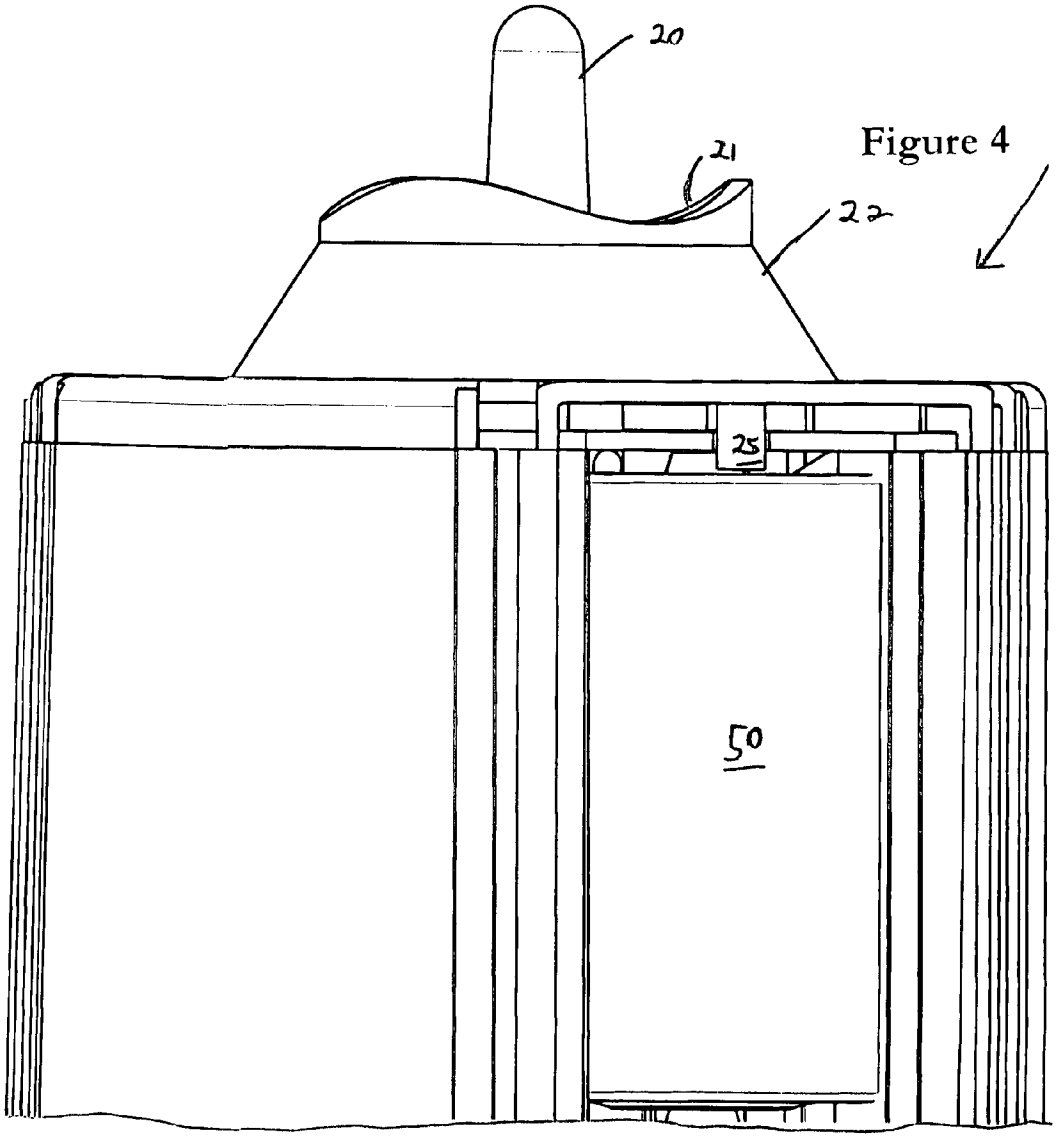
FIG. 4 is a partial sectioned side view of the battery compartment showing battery placement.

Body member 10 is molded with channels 13*a–e* for supporting insertion of elongated supporting channels 3*a–e* therein for placement of the outer curved panels 2*a–e*. As shown in FIGS. 1–3, top cap 4, press fitted on cup member 5, is fitted and fastened over the top ends of curved panels 2*a–e* and elongated supporting channels 3*a–e*. Removable indicia 5*a* (sponsor or cemetery name, advertising, etc.) is placed on ledge 5*c* of cup member 5 and sandwiched in place by clear cover 4. Removal of cap 4 also permits access to recess 5*b* of cup member 5 for placement of symbolic mementos (e.g., pebbles are customary when visiting Jewish gravesites).

Figure 5:
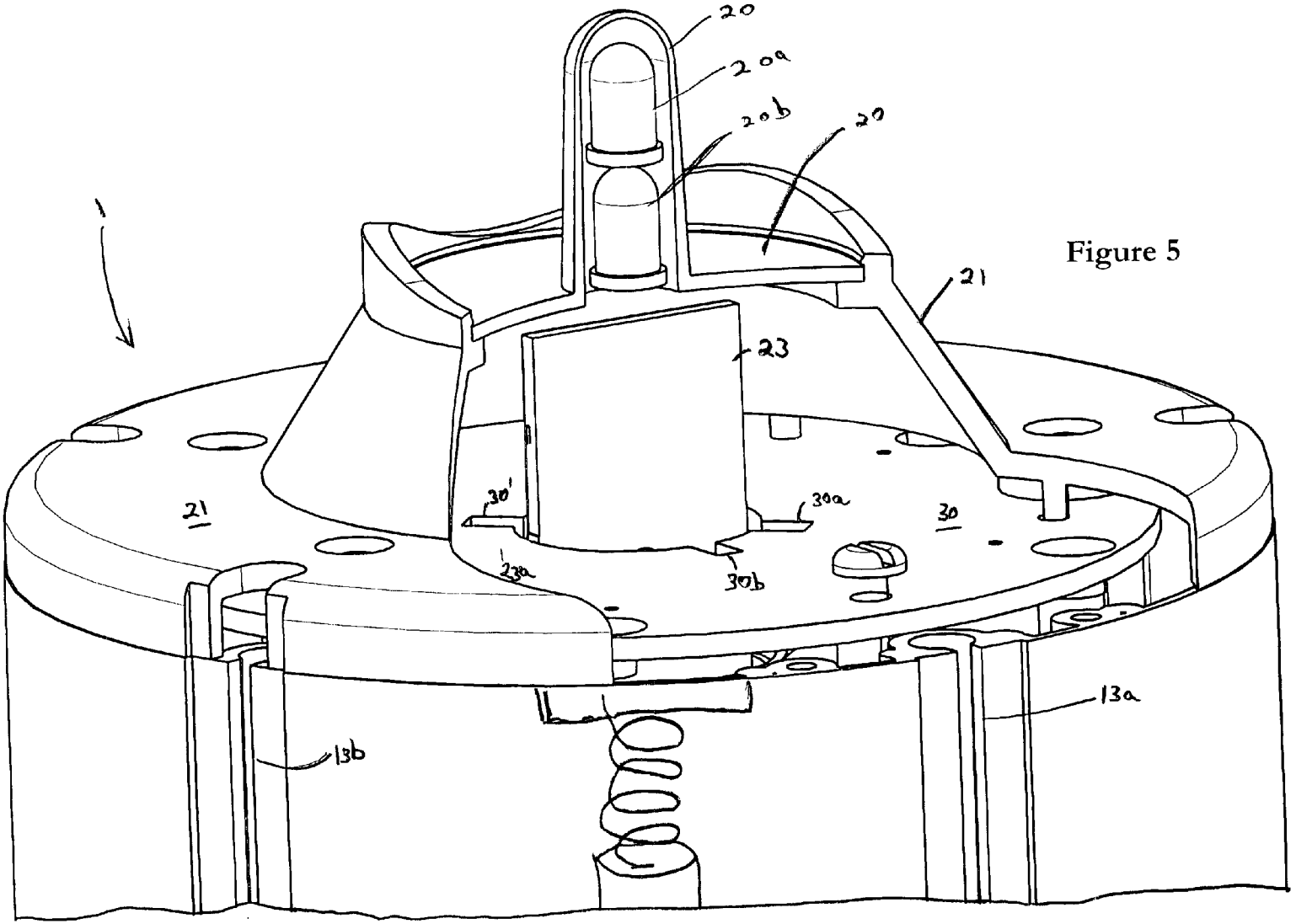
FIG. 5 is a partial perspective sectioned view of the lighting source LEDs and circuit control section of the candle of FIGS. 1 and 2.
Figure 6:
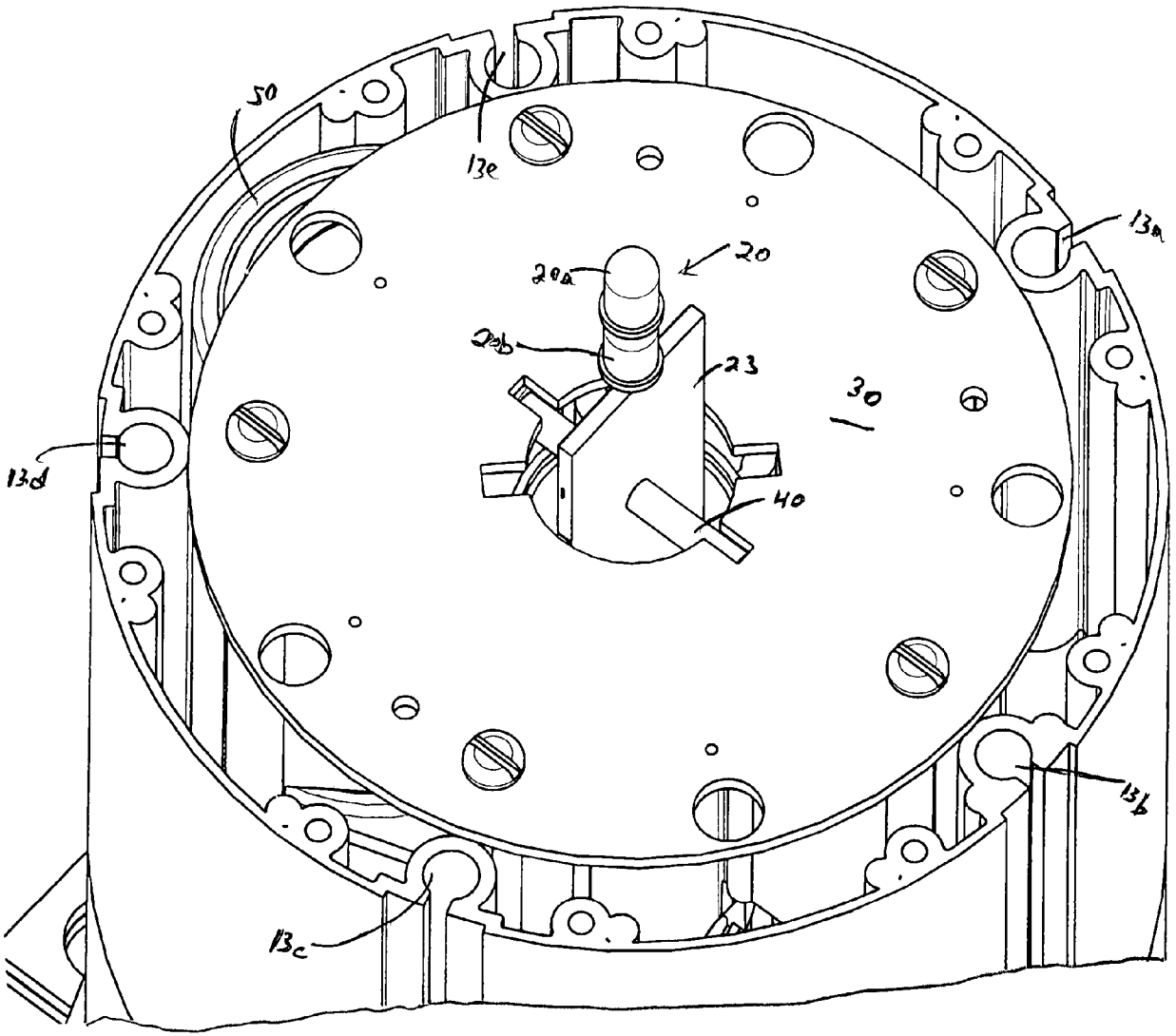
FIG. 6 is a top perspective view of the battery compartment of the candle of FIGS. 1 and 2 with the top covers removed.
Figure 8:
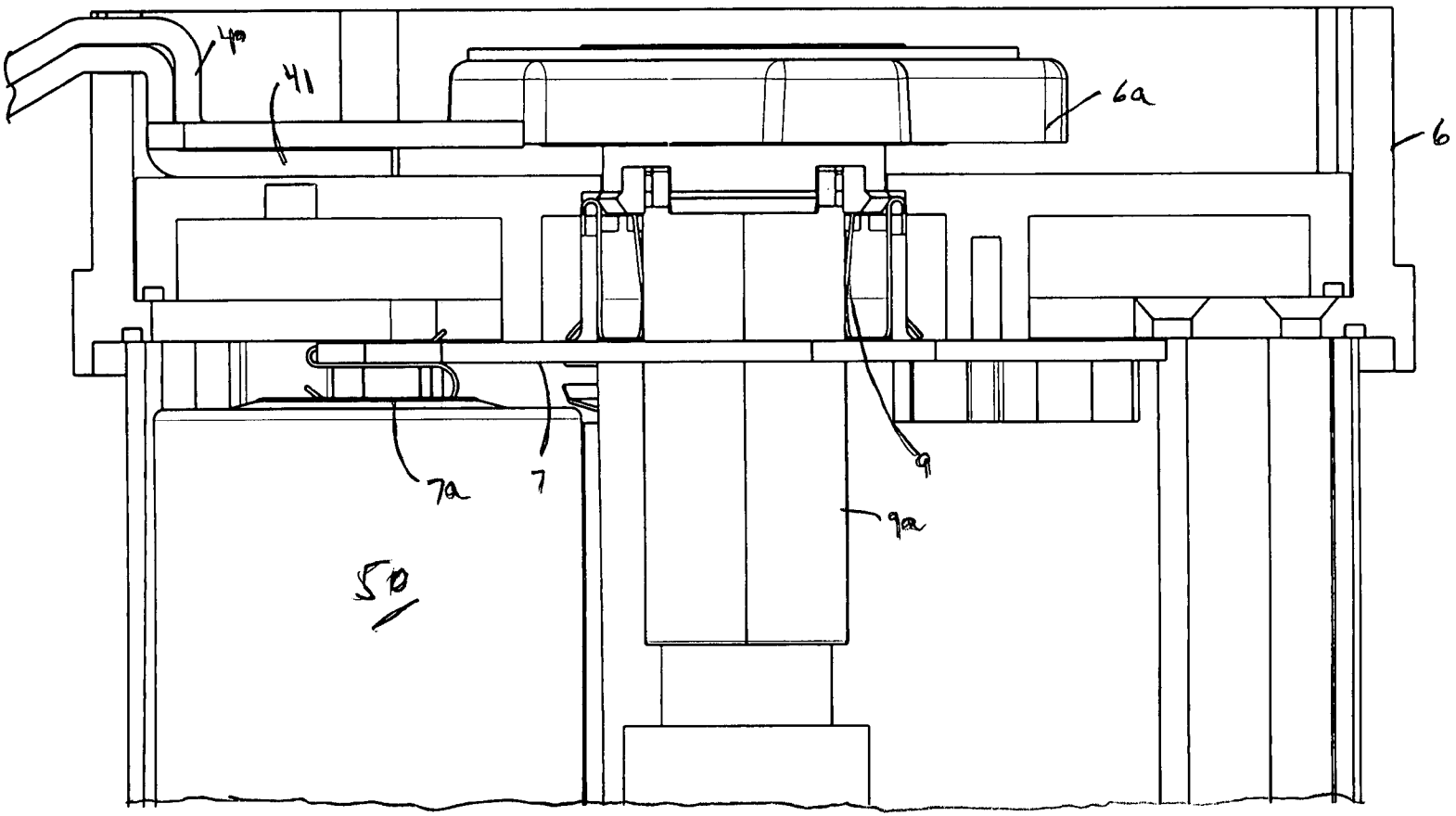
FIG. 8 is a partial sectioned side view of the lower end cap of the candle of FIGS. 1 and 2.

FIGS. 5, 6 and 8 depict the electrical circuit for activation lighting of the LEDs 20*a* and 20*b* of light source 20. LEDs 20*a* and 20*b* are offset from each other and mounted on circuit board 23 and are electrically connected to the circuit thereon. Placement bars 40 extend perpendicularly from the surface of circuit board 23 and conductive spring 23*a* extends from the lower end of circuit board 23 distal to the LED elements. The circuit board 23, with placement bars, spring and LEDs are an integrally replaceable unit or assembly 200. Plate 30 is provided with oppositely extending slots 30*a* and 30*a*' with a dimension longer than and a diameter greater than that of placement bars 40. Slots 30*b* and 30*b*' however have a smaller diameter than placement bars 40. As seen in FIGS. 6 and 8, conductive bar 9 is fixedly positioned within central core cylinder 10' of body member 10. Placement of the assembly 200 entails a "bayonet" type placement, i.e., insertion of the placement bars 40 into slots 30*a* and 30*b* with spring 23*a* being conductively compressed against rod 9. Partial rotation of the circuit board causes the bars to nest into slots 30*b* and 30*b*' to provide positive placement.

Figure 9:
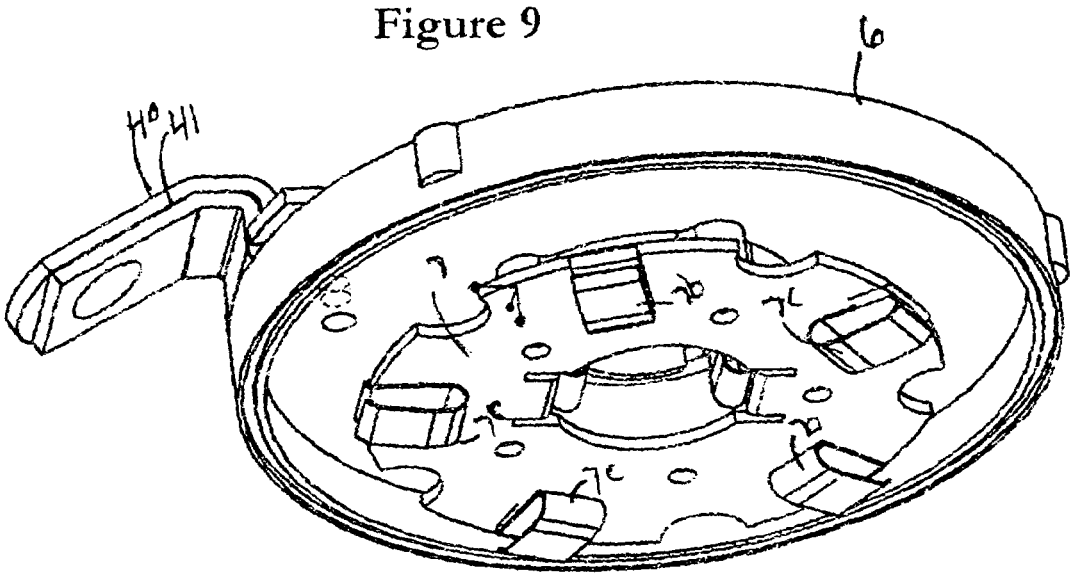
FIG. 9 is a perspective inner view of the lower end cap of the candle of FIG. 7, showing the lower plate battery contact plate.

With reference to FIGS. 7, 8 and 9, end cap 6 is integrated with conductive plate 7, which, in turn, has spring contact elements 7*a–e*. Buttressing, turning handle 6*a* is rotatably affixed to the other side of end cap 6 and is centrally apertured with aperture 6'. The inside of the aperture of the turning handle 6*a* is threaded. Conductive plate 7 is also centrally apertured with aperture 7'. Removal of end cap 6 exposes the open ends of battery compartments 10*a–e* to permit insertion and removal of batteries from the respective compartments. Placement of end cap 6 on the body member results in conductive rod 9 extending through the apertures 7'and 6', in both conductive plate 7 and turning handle 6*a* respectively. Conductive rod 9 is in conductive contact with plate 7 via spring contacts 9*a* within aperture 7'. The end of rod 9 is externally threaded and is thereby adapted to be threadingly engaged with the threads of handle member 6*a* (rod 9 is also hollow at this point and internally threaded as well in order to engage anchoring elements as previously described). Initial threading to fix the end cap 6 on body member 10 and handle 6*a* on rod 9 is not sufficient to complete a circuit. Continued turning of the handle member 6*a* causes it to ride up on rod 9, thereby compressing plate 7 and the spring contacts 7*a–e* to exert a compressive force on batteries 50 contained within the battery compartments 10*a–e* of the body member 10. When sufficient contact is effected to complete a circuit, i.e., as a switch mechanism, the candle lights up. Unthreading turns off the candle by allowing the batteries to fall away from contact with the upper plate 30. The circuit comprises the upper and lower plates 30 and 7 respectively with the batteries 50, rod 9, conductive spring 23*a*, circuit board 23 and LEDs 20*a* and 2*b*. The switch, for activating the circuit, is effected by completing contact between the batteries and upper plate 30 as described.

With reference to FIGS. 7, 8 and 9, in order to prevent the electronic candle from being opened and the batteries therein removed by unauthorized persons, locking mechanism 400 is adapted to prevent turning of the handle 6*a* whereby the end cap 6 cannot be removed. In this regard, end cap 6 has a notch 61 into which is fitted wedge element 40. The wedge element is adapted to fit into engagement with handle 6*a* whereby the handle is prevent from being turned. To prevent the wedge element 40 from being removed it is fastened to the end cap and then the fastener is covered by overlay element 41. Cap member 42 is then fitted over the ends of the wedge element and the overlay element to hold them together. The wedge element, overlay element and cap member are all coextensively apertured for insertion of a lock to effect full closure and prevention of removal of the wedge element.

It is understood that the above description of a specific embodiment is illustrative of the present invention and changes may be made in the structure and configuration of the electronic candle without departing from the scope of the present invention as defined by the following claims.

What is claimed is:

1. An electronic candle comprising an open ended housing body with at least one battery compartment configured for containing at least one battery therein, each of said batteries having respective positive and negative terminals on the opposite ends thereof; wherein said battery compartment is provided with conductive end plates, with said batteries being in electrical contact with one of said plates and wherein said electronic candle comprises means for causing batteries, contained in the battery compartment, to move into electrical contact with the other of said plates to complete a circuit and out of said contact to break the circuit; said candle further comprising a light source, having candle flicker emulation circuitry electrically powered by such completed circuit to provide light from the electric candle, one of said end plates is between said light source and said battery so that said light source is physically separated from said battery.

2. The electronic candle of claim 1, wherein the housing of cylindrical candle comprises a candle emulating form.

3. An electronic candle comprising an open ended housing body with at least one battery compartment configured for containing at least one battery therein, each of said batteries having respective positive and negative terminals on the opposite ends thereof; wherein said battery compartment is provided with conductive end plates, with said batteries being in electrical contact with one of said plates and wherein said electronic candle comprises means for causing batteries, contained in the battery compartment, to move into electrical contact with the other of said plates to complete a circuit and out of said contact to break the circuit; said candle further comprising a light source, having candle flicker emulation circuitry electrically powered by such completed circuit to provide light from the electric candle, wherein said housing supports said light source and wherein translucent decorative enclosure means are integrated with the housing body to enclose the light source therewithin.

4. The electronic candle of claim 1, wherein said electronic candle comprises lockable means for preventing removal of said plates from said housing thereby blocking access to said batteries for removal.

5. The electronic candle of claim 1 wherein said candle comprises indicia displaying means for removably displaying printed indicia through a removable transparent protective element.

6. The electronic candle of claim 1 wherein said candle further comprises openable receptacle means for enclosed placement of mementos.

7. The electronic candle of claim 1, wherein at least one of said plates comprises means for ensuring proper terminal placement of said batteries.

8. An electronic candle comprising an open ended housing body with at least one battery compartment configured for containing at least one battery therein, each of said batteries having respective positive and negative terminals on the opposite ends thereof; wherein said battery compartment is provided with conductive end plates, with said batteries being in electrical contact with one of said plates and wherein said electronic candle comprises means for causing batteries, contained in the battery compartment, to move into electrical contact with the other of said plates to complete a circuit and out of said contact to break the circuit; said candle further comprising a light source, having candle flicker emulation circuitry electrically powered by such completed circuit to provide light from the electric candle, wherein at least one of said plates comprises means for ensuring proper terminal placement of said batteries, wherein said positive terminal of the battery comprises an extending nipple member and said negative terminal comprises a substantially flat element and wherein said means for ensuring proper terminal placement of said batteries comprise protrusion elements integrated with one of said plates and positioned offset from contact with a battery nipple member, said protrusion having an extension distance less that that of said nipple member, whereby said positive terminal is able to make conductive contact with said plate having said protrusion elements and said negative terminal is not able to make such conductive contact.

9. An electronic candle comprising a light source, an open ended housing body with at least one battery compartment configured for containing a plurality of batteries therein, adjacent said light source, with each of said batteries having respective positive and negative terminals on the opposite ends thereof; wherein said battery compartment is provided with a conductive end element for electrical contact with at least one of said positive and negative terminals respectively distal to said light source, and a conductive end element for electrical contact with the other of said positive and negative terminals and electrical contact with said light source and wherein said housing comprises means for preventing battery terminals adjacent said light source from direct physical contact with said light source and wherein said electronic candle housing comprises a moveable end cap element for closing said open housing positioned adjacent to the conductive end element distal to the light source, with movement of the end cap element causing at least one of the batteries, contained in the battery compartment, adjacent to the light source to be placed into electrical contact with the light source to complete a circuit and wherein reverse movement of the end cap element causes breakage of the electrical contact to break the circuit; said light source, having candle flicker emulation circuitry electrically powered by said completed circuit to provide candle flicker emulation light from the light source and the electric candle.

10. The electronic candle of claim 9 wherein the terminals of batteries adjacent said light source are not in longitudinal alignment with said light source.

11. The electronic candle of claim 9 wherein the batteries are arranged in any of series, parallel and combined series and parallel, electrical configuration.

* * * * *